United States Patent [19]

Tanaka et al.

[11] 4,030,460

[45] June 21, 1977

[54] IGNITION TIMING CONTROL APPARATUS FOR INTERNAL COMBUSTION ENGINE

[75] Inventors: Minoru Tanaka, Chofu; Syoichi Otaka, Saitama, both of Japan

[73] Assignee: Honda Giken Kogyo Kabushiki Kaisha, Tokyo, Japan

[22] Filed: Nov. 21, 1975

[21] Appl. No.: 634,154

[30] Foreign Application Priority Data

Nov. 28, 1974 Japan ..... 49-143093[U]

[52] U.S. Cl. ..... 123/117 A

[51] Int. Cl.[2] ..... F02P 5/14

[58] Field of Search ..... 123/117 A

[56] References Cited

UNITED STATES PATENTS

| | | | |
|---|---|---|---|
| 2,876,754 | 3/1959 | Obermaier | 123/117 A |
| 3,606,871 | 9/1971 | Gropp | 123/117 A |
| 3,704,697 | 12/1972 | Weymann | 123/117 A |
| 3,930,474 | 1/1976 | Kawai | 123/117 A |

*Primary Examiner*—Robert G. Nilson
*Attorney, Agent, or Firm*—Lyon & Lyon

[57] ABSTRACT

Ignition timing control apparatus for an internal combustion engine driving a vehicle through an automatic transmission includes a vacuum actuator connected to turn a point base about the axis of the rotary cam which operates the breaker points. The vacuum actuator is connected by a conduit to an intake passage in the engine downstream from the throttle valve. An electromagnetic selector valve is placed in the conduit and acts to connect the vacuum actuator either to the engine intake passage or to atmosphere. A temperature responsive member operates an electric switch to control the selector valve. A check valve and a restricted orifice are mounted in parallel in said conduit between the selector valve and the vacuum actuator.

2 Claims, 3 Drawing Figures

FIG. 1.
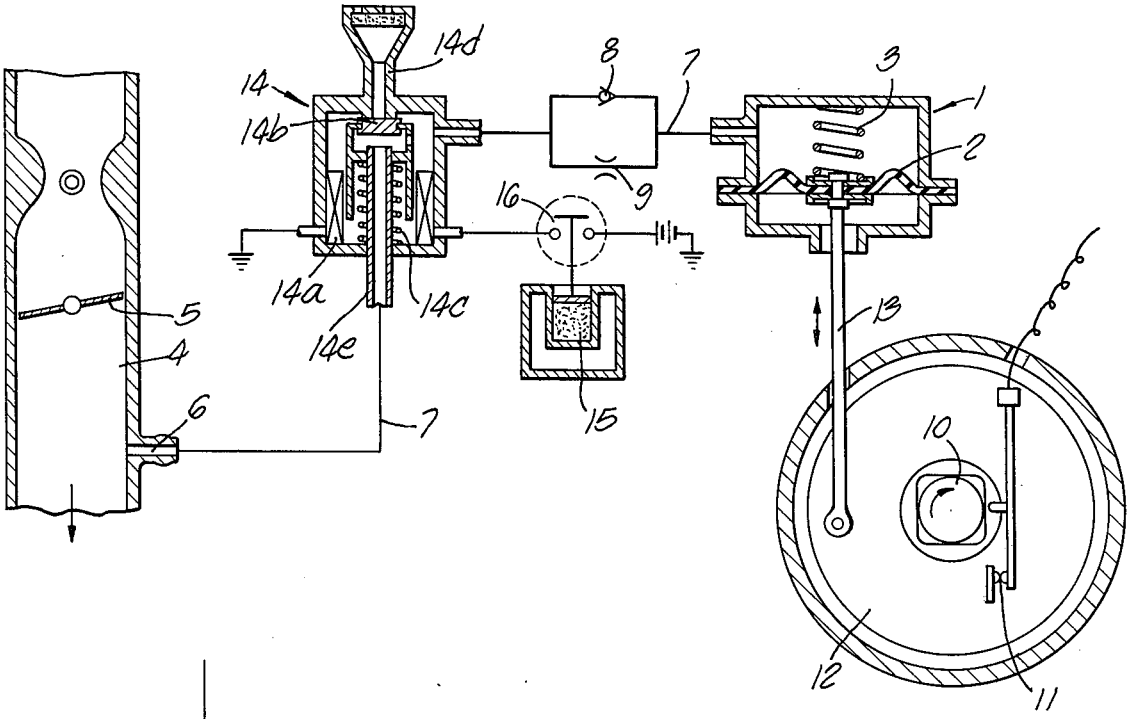
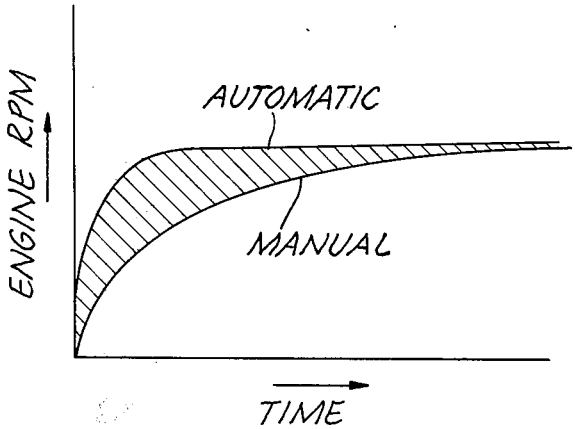
FIG. 2.
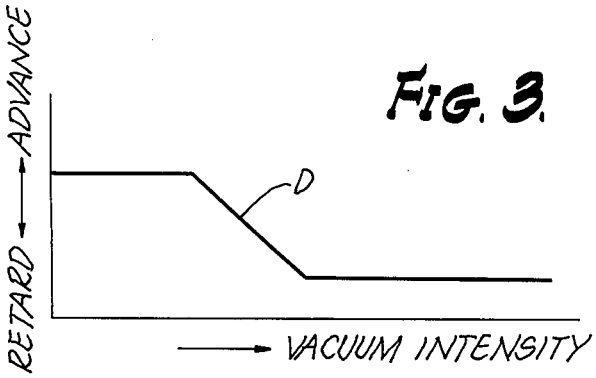
FIG. 3.

IGNITION TIMING CONTROL APPARATUS FOR INTERNAL COMBUSTION ENGINE

This invention relates to ignition timing control apparatus for an internal combustion engine, the engine being mounted in the vehicle, for example an automobile, the engine driving the vehicle through an automatic transmission employing a torque converter or a fluid coupling. Normally, engine powered vehicles equipped with an automatic transmission, when compared with vehicles having manually operated gear change mechanisms, are required to rotate at higher engine RPM in order to achieve an acceleration of the vehicle to the same running speed. This is attributable to the fact that slippage to some extent is produced in the torque converter of fluid coupling in the power train.

In the past, engines driving the vehicles through manual gearshift transmission have been equipped with ignition timing control systems of the vacuum responsive type to retard the ignition timing during low speed operation to lessen the amount of pollutants in the exhaust gases. In such engines, so equipped, the ignition timing was advanced during high speed operation to improve the power output characteristics of the engine. However, if such an ignition timing control device is applied to an engine driving a vehicle through an automatic transmission, the angle of advance of the ignition timing is performed so rapidly as to result in an increase of pollutants in the exhaust gases.

Specificaly, if the engine is equipped with an ignition timing control system having an operation characteristic as shown by line D in FIG. 3, a decrease in the intensity of the intake vacuum as a result of increase in the engine speed serves to advance the ignition timing. However, in the case of engines with automatic transmissions, the angle of advance is made relatively quickly and results in an increase of pollutants discharged into the atmosphere. Consequently, it is desirable that the angle advance of the ignition timing be delayed to some extent.

The object of this invention is to provide ignition timing control apparatus for use with engines driving vehicles through automatic transmissions having a torque converter or fluid coupling, the ignition timing control incorporating delay means to avoid too rapid advance of the ignition timing, but without adversely affecting power output of the engine at higher vehicle speeds.

Other and more detailed objects and advantages will appear hereinafter.

In the drawings:

FIG. 1 is a schematic diagram, partly in section, showing a preferred embodiment of this invention.

FIG. 2 is a graph showing the relationship of engine RPM to time for engines equipped with automatic transmissions, or manual gearshift transmissions.

FIG. 3 is a diagram showing how the spark time is advance or retarded as a result of vacuum intensity in the engine intake passage.

Referring to the drawings, an increase in vacuum intensity in the vacuum actuator 1 causes a vacuum response diaghragm 2 to retract against the action of the coil spring 3. This motion is communicated through the rod 13 to cause clockwise movement of the point base 12 and breaker points 11 about the axis of the rotary cam 10. This retards the ignition timing, as will be readily understood. During idling of the engine with the throttle valve 5 closed, as shown, a relatively intense vacuum in the intake passage 4 is produced. This acts through the vacuum connection 6 and is applied to the vacuum actuator 1 in the manner described below.

A selector valve 14 of the electromagnetic type is placed in the conduit 7 connecting the vacuum connection 6 to the vacuum actuator 1. The selector valve 14 operates in response to engine temperature in a manner such that when the valve 14 is electrically energized, the vaccum actuator 1 is connected to atmosphere. Specifically, a detector generally designated 15 closes an electric switch 16 when the temperature falls below a predetermined value. Closing of the switch 16 energizes the solenoid **14*a* of the selector valve 14 to cause the valve element 14*b* within it to move against the force of a coil spring 14*c*, thereby closing the pipe 14*e* and opening the pipe 14*d* to atmosphere. Atmospheric pressure is thus introduced into the vacuum actuator 1, causing the vacuum response diaphragm 2 to project the rod 13 and cause counterclockwise movement of the point base 12**, thereby advancing the spack timing. From this description it will be understood that when the engine temperature is low, the ignition timing is advanced so that an increase in unwanted exhaust emissions is avoided and the operation of the engine becomes smoother.

When the vehicle is operated at relatively low speeds and the engine is turning at low RPM, the vacuum intensity is high in the intake passage 4. This is reflected through the conduit 7 to vacuum actuator 1 to retard the ignition timing of the engine, thus avoiding an increase in unwanted pollutants in the exhaust gases. When the throttle valve 5 is opened to increase the engine RPM so as to accelerate the vehicle, the vacuum intensity is lessened in the intake passage 4. This in turn reduces the vacuum intensity in the vacuum actuator 1 to cause the ignition timing to be advanced, thereby improving the output characteristics of the engine. However, the presence of the restricted orifice 9 in the conduit 7 causes a delay in the advance of the ignition timing, and this also serves to prevent increase in unwanted emissions. Thus, in the case of vehicles powered through automatic transmissions, a disadvantage is avoided by delaying the advance of the ignition timing.

When the throttle valve 5 closes as the vehicle decelerates, the vacuum intensity increases in the intake passage 4. At this moment, however, the check valve 8 mounted in parallel with the restricted orifice 9 opens to permit the higher vacuum intensity to act immediately on the vacuum actuator 1, so that retarding of the ignition timing acts immediately to remedy deterioration of exhaust emissions.

Having fully described our invention, it is to be understood that we are not to be limited to the details herein set forth but that our invention is of the full scope of the appended claims.

We claim:

1. For use with an internal combustion spark ignition engine connected to drive a vehicle through an automatic transmission having a torque converter or fluid coupling, the engine including an intake passage, a throttle valve in said intake passage, and a distributor having a movable spark adjusting base, ignition timing control apparatus for the engine comprising, in combination: a vacuum actuator having a movable wall connected to the spark adjusting base, a spring urging said movable wall toward a spark advance position, an increase of vacuum intensity in said vacuum actuator moving said movable wall toward a spark retard position against said spring, a conduit connecting the vacuum actuator to said intake passage of the engine downstream from said throttle valve, a selector valve in said conduit having a valve element movable to connect the vacuum actuator to either the engine intake passage or to atmosphere, a member responsive to engine temperature connected to operate the selector valve to cause said vacuum actuator to be connected to atmosphere when the engine temperature is below a predetermined value or to cause said vacuum actuator to be connected to the intake passage downstream from the throttle valve when the engine temperature is above said predetermined value, a check valve and a restricted orifice mounted in parallel in said conduit between the selector valve and the vacuum actuator, said check valve permitting flow through the conduit from the vacuum actuator but preventing reverse flow, whereby a reduction of vacuum intensity in the engine intake passage when the engine is warm causes said check valve to close and causes the restricted orifice to delay advance of the ignition timing, but an increase of vacuum intensity in the engine intake passage causes an immediate retarding of the ignition timing.

2. The combination set forth in claim 1 in which said selector valve is electrically operated and wherein the temperature responsive member operates an electric swtich connected to said electrically operated selector valve.

* * * * *